US007278910B1

(12) United States Patent
Jernigan

(10) Patent No.: US 7,278,910 B1
(45) Date of Patent: Oct. 9, 2007

(54) WHEEL SCRAPER FOR A FLOOR SANDER

(76) Inventor: George A. Jernigan, 5091 Antioch Rd., Crestview, FL (US) 32536

( * ) Notice: Subject to any disclaimer, the term of this patent is extended or adjusted under 35 U.S.C. 154(b) by 286 days.

(21) Appl. No.: 10/955,073

(22) Filed: Sep. 30, 2004

(51) Int. Cl.
*B24B 23/02* (2006.01)

(52) U.S. Cl. ..... 451/350; 15/256.51; 280/855; 451/352; 451/353; 451/442

(58) Field of Classification Search ..... 15/256.5, 15/256.51, 256.52; 280/855, 856, 158.1; 451/344, 350, 352, 353, 415, 442
See application file for complete search history.

(56) References Cited

U.S. PATENT DOCUMENTS

| | | | | |
|---|---|---|---|---|
| 139,364 | A | | 5/1873 | Brown |
| 168,675 | A | | 10/1875 | Sage |
| 185,662 | A | | 12/1876 | Bacon |
| 254,444 | A | | 3/1882 | Mercer |
| 388,378 | A | | 8/1888 | Sparrou |
| 581,047 | A | | 4/1897 | Taylor |
| 592,519 | A | | 10/1897 | Gray |
| 601,623 | A | | 4/1898 | Ash |
| 612,819 | A | | 10/1898 | Brusseau |
| 621,882 | A | | 3/1899 | Whipp |
| 677,073 | A | | 6/1901 | Foyelstrom |
| 687,208 | A | | 11/1901 | Doyle |
| 705,123 | A | | 7/1902 | Oustler |
| 1,704,465 | A | * | 3/1929 | Donham ..... 280/855 |
| 1,782,085 | A | * | 11/1930 | Zerwig ..... 280/855 |
| 1,933,679 | A | * | 11/1933 | Nicewander et al. ..... 280/855 |
| 2,770,464 | A | | 11/1956 | Seda |
| 2,937,883 | A | | 5/1960 | Aliorisoi |
| 3,127,190 | A | | 3/1964 | Thesmar |
| 3,231,293 | A | | 1/1966 | Loustaunau |
| 4,418,776 | A | * | 12/1983 | Weirick ..... 180/19.3 |
| 4,605,239 | A | | 8/1986 | Warfel |
| 5,524,913 | A | | 6/1996 | Kulbeck |
| 6,434,781 | B1 | | 8/2002 | Guerra |

* cited by examiner

*Primary Examiner*—Timothy V. Eley
(74) *Attorney, Agent, or Firm*—Peter Loffler

(57) ABSTRACT

A wheel scraper for a floor sander attaches to the swivel support wheel of a floor sander and scraper debris from the support wheel in order to prevent debris accumulation on the support wheel. The device includes a frame that attaches to the floor sander and that positions a scraper arm that contacts the rolling surface of the support wheel. A spring biases the scraper arm against the support wheel. The scraper arm has a generally U-shaped opening that receives the support wheel and that also scrapes debris from the side walls of the support wheel.

3 Claims, 3 Drawing Sheets

WHEEL SCRAPER FOR A FLOOR SANDER

BACKGROUND OF THE INVENTION

1. Field of the Invention

The present invention relates to a wheel scraper that is attached to a standard floor sander and the scrapes the swivel support wheel of the floor sander in order to keep the swivel support wheel relatively free of debris accumulation.

2. Background of the Prior Art

Floor sanders are wonderful tools for preparing floors for refinishing by sanding and removing the top layer of a wood or similar-materialed floor in order that this top layer can be replaced during the refinishing process. The floor sander works by providing an abrasive surface, such as a layer of sand paper, and rotating, either in a circling fashion or on an endless loop belt, this abrasive layer. As the rotating abrasive layer makes contact with the floor surface, the abrasive layer slowly causes the top of the floor surface to be ground off. The modern floor sander is an excellent tool for use in floor refinishing.

One problem experienced with floor sanders by operators of such devices is that some of the floor debris that is ground off by the floor sander accumulates on the wheels including the swivel support wheel of the floor sander. This problem is especially pronounced when sanding floors that have a relatively high oil content in the top surface from recent oiling or other coating activities. The impregnated oil helps make the ground off debris especially sticky and prone to accumulate on the wheels. As the debris on the swivel support wheel accumulates, the floor sander becomes ever more difficult to control and to turn. With sufficient debris accumulation, the swivel support wheel can cease rotation altogether, effectively rendering the floor sander inoperative. Additionally, floor digging can occur.

Typically, once sufficient debris has accumulated on the wheels, the operator of the floor sander, stops the floor sander and removes the accumulated debris using an appropriate tool, such as an appropriate abrasive surface tool or a knife. This operation is performed directly on the floor sander, or in some cases, the swivel support wheel is removed prior to cleaning. In either case, the process is time-consuming and labor intensive and reduces the overall efficiency of the operator.

Accordingly, there exists a need in the art for a device that allows the swivel support wheel to be relatively free of debris accumulation on the surface thereof in order to prevent the operator from having to make frequent time-consuming and labor intensive stops to the floor sanding process in order to remove debris that has accumulated on the swivel support wheel. Such a device must be of relatively simple design and construction so as to be relatively affordable and must be relatively easy to install on most existing floor sanders without the need to make excessive modifications to the floor sander. Ideally, such a device can also be attached to the other wheels of the sander in order to keep these other wheels relatively free of accumulated debris.

SUMMARY OF THE INVENTION

The wheel scraper for a floor sander of the present invention addresses the aforementioned needs in the art. The wheel scraper for a floor sander allows the swivel support wheel of the floor sander to remain relatively free of debris accumulation on the surface thereof during the floor sanding operation in order to prevent the operator from having to make frequent time-consuming and labor intensive stops to the floor sanding process in order to remove debris that has accumulated on the swivel support wheel. The wheel scraper for a floor sander is of relatively simple design and construction making the device relatively affordable and is relatively easy to install on most existing floor sanders without the need to make excessive modifications to the floor sander. The present invention can also be attached to the other wheels of the floor sander in order to keep these wheels relatively free of debris accumulation.

The wheel scraper for a floor sander of the present invention is comprised of a frame member that is attached to a floor sander. A scraper arm is attached to the frame member and is positioned as to contact the rolling surface and the side walls of the swivel support wheel of the floor sander. A spring is positioned between the frame member and the scraper arm for biasing the scraper arm onto the surface of the swivel support wheel. An adjustment mechanism adjusts the bias of the spring. The scraper arm has a U-shaped opening that provides the contact with the rolling surface and the side walls of the swivel support wheel. The scraper arm is pivotally attached to the frame member.

BRIEF DESCRIPTION OF THE DRAWINGS

Similar reference numerals refer to similar parts throughout the several views of the drawings.

DESCRIPTION OF THE PREFERRED EMBODIMENT

Figure 1:
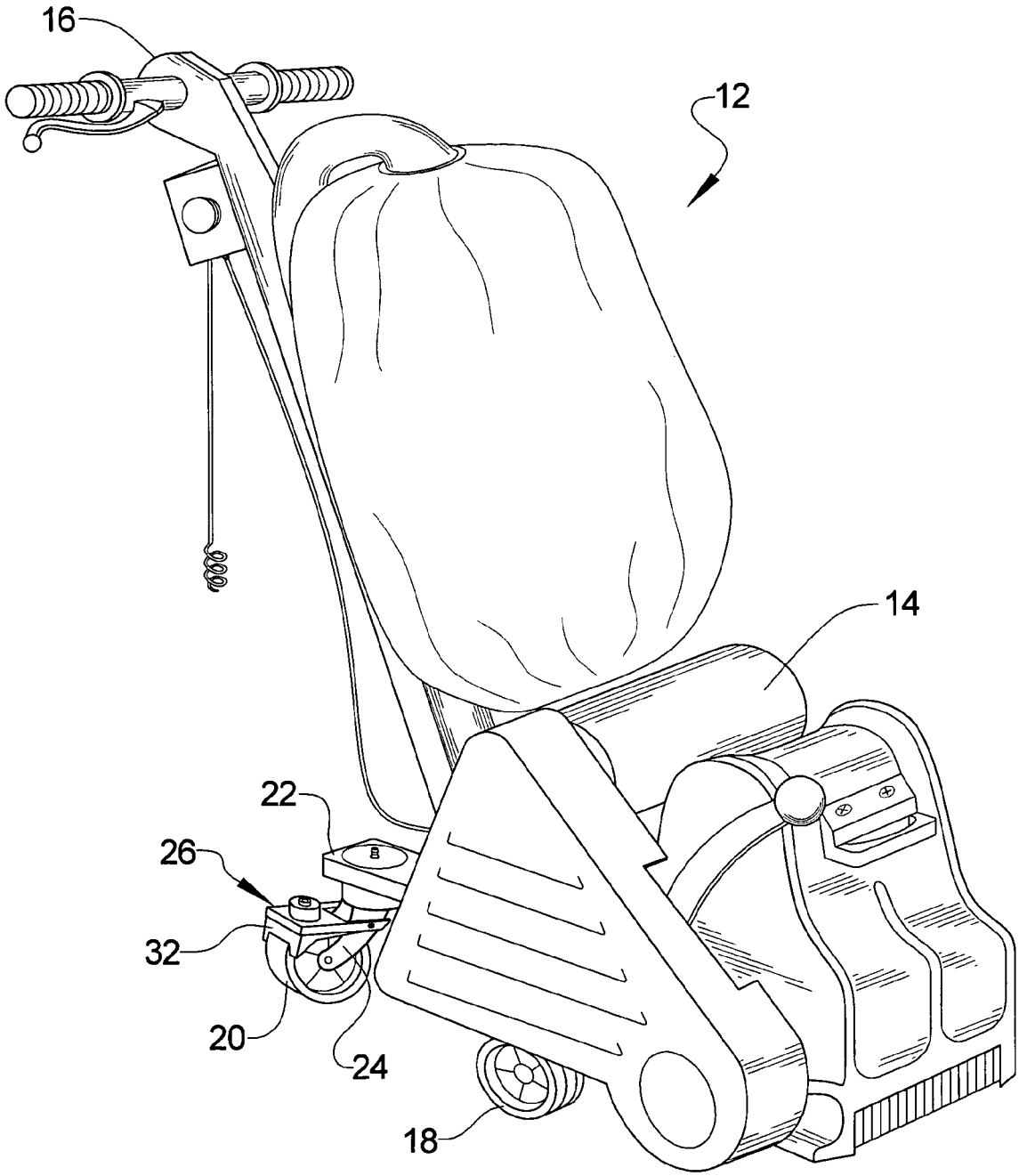
FIG. 1 is a perspective view of a floor sander having the wheel scraper for a floor sander of the present invention installed thereon.
Figure 2:
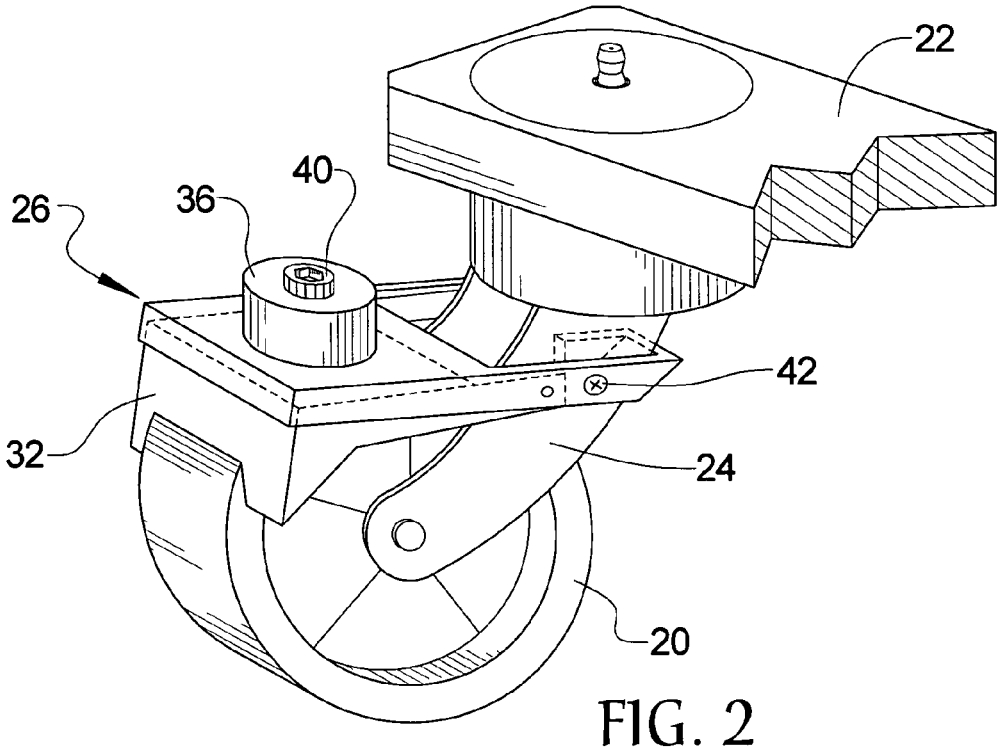
FIG. 2 is a close-up perspective view of the wheel scraper for a floor sander attached to the swivel support wheel of the floor sander.
Figure 3:
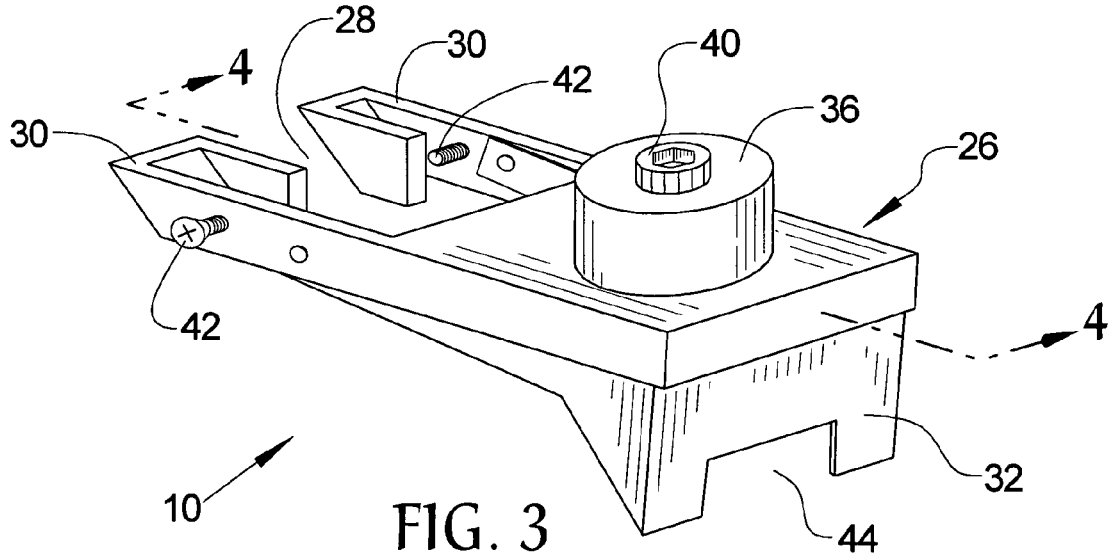
FIG. 3 is a close-up perspective view of the wheel scraper for a floor sander.
Figure 4:
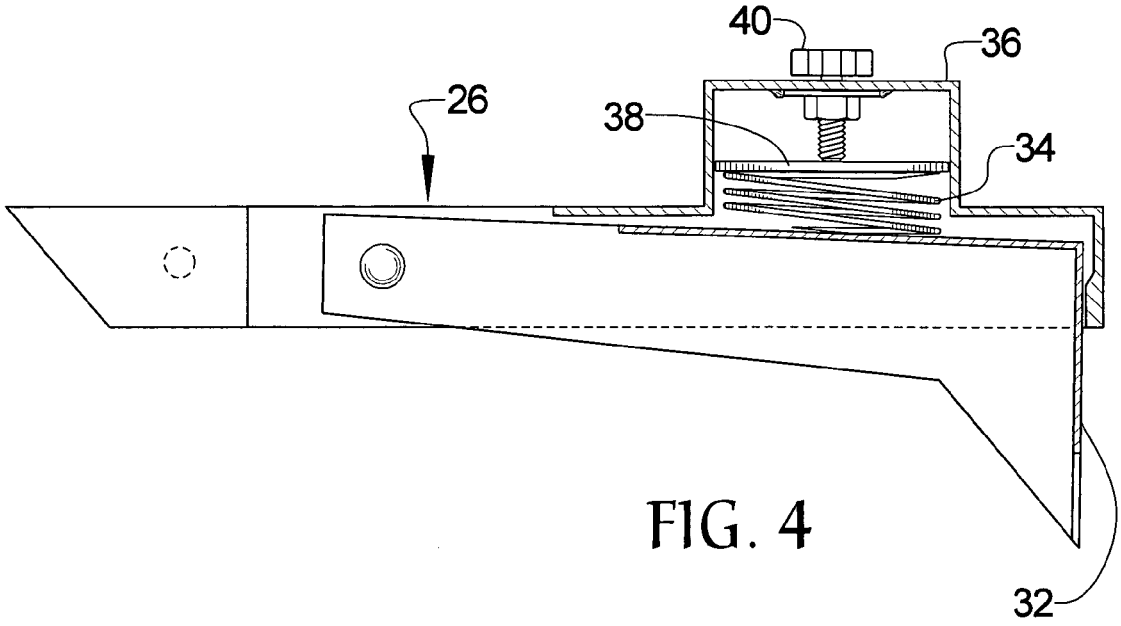
FIG. 4 is a sectioned view of the wheel scraper for a floor sander taken along line 4-4 in FIG. 3.
Figure 5:
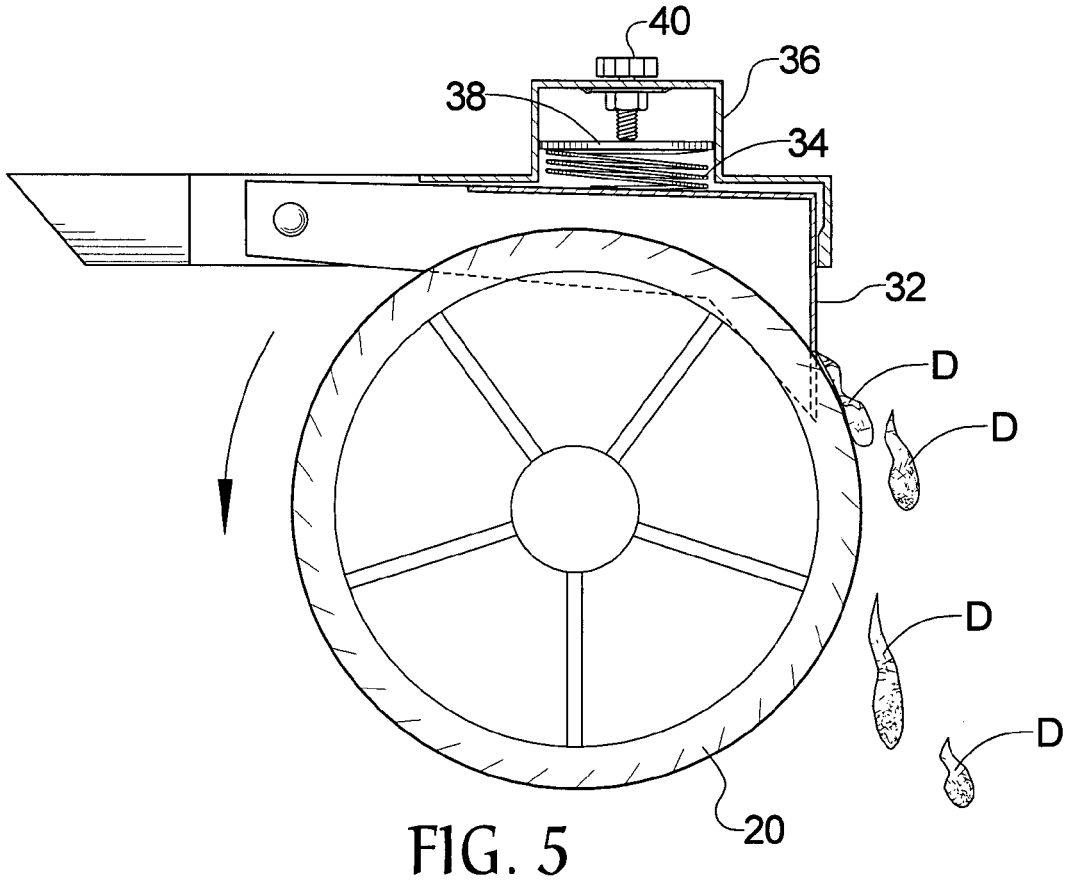
FIG. 5 is a side view, partially sectioned, of the wheel scraper for a floor sander in operation.

Referring now to the drawings, it is seen that the wheel scraper for a floor sander, generally denoted by reference numeral 10, is attached to a typical floor sander 12 that has a frame 14, a handle 16, a pair of fixed support wheels 18 and a swivel support wheel 20 that is attached to a support base 22 by a pair of castor supports 24, the floor sander 12 being normally operated in the usual way. The wheel scraper for a floor sander 10 is comprised of a frame member 26 that has a support opening 28 flanked by a pair of U-shaped extensions 30. A scraper arm 32 extends downwardly from the frame member 26 on a side opposite the side having the support opening 28. As seen in FIGS. 4 and 5, the scraper arm 32 is pivotally attached to the frame member 26 at a medial point of the frame member 26. A spring 34 biases the scraper arm 32 downwardly. As seen, the spring 34 is housed within a spring housing 36 that forms a part of the top of the frame member 26. One end of the spring 34 biases against the scraper arm 32 while the opposing end of the spring 34 biases against a plate member 38 held within the spring housing 36. An adjustment screw 40 passes through the spring housing 36 and abuts the top of the plate member 38 in order to adjust the bias of the spring 34.

In order to install the wheel scraper for a floor sander 10 onto the floor sander 12, the frame member 26 is positioned such that the castor supports 24 of the floor sander 12 are received within the support opening 28 of the wheel scraper for a floor sander 10. Each arm of the castor supports 24 is positioned so as to be received within one of the U-shaped extensions 30. In this position, the scraper arm 32 sits on the surface of the swivel support wheel 20. A pair of screws 42 pass through the extensions 30 in order to attach the frame member 26 to the castor support 24. The screws 42 can also pass through the castor supports 24 or clamp against the castor supports 24 so as to not violate and potentially weaken the castor supports 24. If desired, the screw threads can be pretreated with an appropriate locking agent to prevent screw 42 displacement due to vibration.

The frame member 26 and the scraper arm 32 are each made from an appropriate material such as metal or hard plastic.

In this attached position, the scraper arm 32 sits on the rolling surface (the surface of the swivel support wheel 20 that makes contact with the floor) of the swivel support wheel 20, and as seen, the scraper arm 32 has a U-shaped opening 44 so that at least of a portion of the side walls of the swivel support wheel 20 are contacted by the scraper arm 32. The spring 34 biases the scraper arm 32 down onto the surface of the swivel support wheel 20. The bias of the spring 34 is adjusted as needed by the adjustment screw 40. The scraper arm 32 should provide sufficient scraping action without causing undue wear of the swivel support wheel 20.

In operation, the floor sander 12 is operated in usual fashion. The scraper arm 32 sits on the rolling surface of the swivel support wheel 20 and scrapes off debris D that tries to accumulate thereon as the swivel support wheel 20 rotates. The spring 34 provides sufficient bias to provide sufficient scraping power to the scraper arm 32. If the scraper arm 32 is not providing sufficient contact pressure, the bias of the spring 34 is increased by rotation of the adjustment screw 40 and if the scraper arm 32 is providing too much pressure, and thus impeding travel of the swivel support wheel 20, the adjustment screw 40 is counterrotated in order to reduce the bias of the spring 34 and thus reduce some of the contact pressure. As the scraper arm 32 has a U-shaped opening 44, at least some of the side walls of the swivel support wheel 20 are scraped of debris by the scraper arm.

It is expressly recognized that the above description is illustrative of a typical attachment methodology of the wheel scraper for a floor sander 10 to a floor sander. Different attachment schemes of wheel scraper for a floor sander 10 to floor sander are possible depending on the specific architecture of the floor sander 12. Additionally, the wheel scraper for a floor sander 10 can also be attached to the fixed support wheels 18 in order to scrape these wheels 18 and keep them relatively free of debris accumulation.

While the invention has been particularly shown and described with reference to an embodiment thereof, it will be appreciated by those skilled in the art that various changes in form and detail may be made without departing from the spirit and scope of the invention.

I claim:

1. A scraping device, in combination with a floor sander that abrasively sands and removes a top layer of a wood or wood-like floor, the floor sander having a swivel support wheel with a rolling surface and side walls, the swivel support wheel swivelly attached to a support base of the floor sander by a pair of castor supports that depend downwardly from the support base the scraping device comprising:

a frame member that is fixedly attached to the castor supports of the floor sander above the swivel support wheel whenever the floor sander is in an upright position;

a scraper arm pivotally attached to the frame member, the scraper arm having a flat outer surface that has a U-shaped opening such that the scraper arm is positioned so as to depend downwardly in order to contact the swivel support wheel of the floor sander such that the opening faces downwardly whenever the floor sander is in the upright position and straddles the swivel support wheel so that the scraper arm contacts the rolling surface and the side walls of the swivel support wheels and scrapes the rolling surface and the side walls of the upwardly approaching swivel support wheel whenever the swivel support wheel is rotating along the floor; and a spring positioned between the frame member and the scraper arm for changing the pivotal relationship between the frame member and the scraper arm and thereby biasing the scraper arm onto the swivel support wheel.

2. The scraping device as in claim 1 further comprising an adjustment mechanism for adjusting the bias of the spring.

3. The scraping device as in claim 1 wherein the spring directly abuts against the scraper arm.

* * * * *